US005126079A

United States Patent [19]

Nagamatsu

[11] Patent Number: 5,126,079

[45] Date of Patent: Jun. 30, 1992

[54] CARBURETOR

[76] Inventor: James Nagamatsu, 100 Peralta Hills Dr., Anaheim, Calif. 92807

[21] Appl. No.: 615,600

[22] Filed: Nov. 19, 1990

[51] Int. Cl.[5] ..... F02M 7/22

[52] U.S. Cl. ..... 261/44.7; 261/50.2

[58] Field of Search ..... 261/44.2, 50.2, 44.7

[56] References Cited

U.S. PATENT DOCUMENTS

| | | | |
|---|---|---|---|
| 920,979 | 5/1909 | Morehouse | 261/44.7 |
| 1,120,183 | 12/1914 | Duff | 261/41.4 |
| 1,178,960 | 4/1916 | Smith | 261/44.2 |
| 1,828,902 | 10/1931 | Monosmith et al. | 261/50.2 |
| 2,709,579 | 5/1955 | Sykes | 261/44.7 |
| 2,995,349 | 8/1961 | Kennedy, Sr. | 261/44.2 |
| 3,362,694 | 1/1968 | Gould | 261/50.2 |
| 3,711,068 | 1/1973 | Perry | 261/44.2 |
| 3,752,451 | 8/1973 | Kendig | 261/44.7 |
| 4,052,488 | 10/1977 | Schoeman | 261/50.2 |
| 4,058,102 | 11/1977 | Fabritz | 261/78.2 |
| 4,283,355 | 8/1981 | Herd, Jr. et al. | 261/44.7 |
| 4,364,364 | 12/1982 | Subramaniam | 123/527 |
| 4,370,969 | 2/1983 | Zarrelli et al. | 123/525 |
| 4,398,521 | 8/1983 | Schuurman | 123/527 |
| 4,479,466 | 10/1984 | Greenway et al. | 123/527 |
| 4,482,507 | 11/1984 | Kendig | 261/50.2 |
| 4,497,304 | 2/1985 | Wintrell et al. | 123/527 |
| 4,872,440 | 10/1989 | Green | 123/590 |

FOREIGN PATENT DOCUMENTS

| | | | |
|---|---|---|---|
| 397045 | 4/1909 | France | 261/41.4 |
| 149047 | 7/1985 | United Kingdom . | |

*Primary Examiner*—Tim Miles

*Attorney, Agent, or Firm*—Knobbe, Martens, Olson & Bear

[57] ABSTRACT

The improved carburetor of the present invention provides for direct mechanical control of both an airflow valve and a fuel dispersion assembly such that operation of the airflow valve regulates the amount of air flowing through the carburetor. The fuel dispersion assembly and the airflow valve are mechanically connected by a three bar linkage assembly; the middle linkage being of adjustable length. Mounted within the carburetor is a throttle valve which, when opened, affects the position of the airflow valve. The fuel dispersion assembly comprises a pair of concentric tubes, one rotatable relative to the other and both having one or more radial slots therethrough. A center tube, or "slave" tube, contains fuel from a fuel storage tank. An outer tube, or "sleeve" tube remains affixedly secured to the carburetor. Upon rotation of the slave tube within the sleeve tube, a portion of the slots in each tube overlap, providing a passageway for the fuel, contained in the slave tube, to disperse within the carburetor. The slots located on the sleeve tube are oriented downwardly so that fuel is dispersed through the sleeve tube toward the bottom of the carburetor in a fan-like configuration—the arc of the fan varying with the amount of slot overlap and thus the amount of fuel dispersed.

11 Claims, 4 Drawing Sheets

CARBURETOR

FIELD OF THE INVENTION

The present invention relates to a carburetor for the controlled mixture of air and fuel for entry into an internal combustion engine, and more particularly, to an improved carburetor having a direct control between the air flow and the fuel flow.

BACKGROUND OF THE INVENTION

Most conventional internal combustion engines, such as those used on motorized vehicles, including automobiles and boats, use a mixture of fuel and air for combustion. The fuel can comprise gasoline, diesel fuel, or compressed gas such as propane. This mixture is drawn into the engine through a carburetor by a negative pressure created during intake strokes of engine operation. Alternately, a carburetor is not used but the fuel is injected by mechanical or electronic means directly into the combustion chambers or the intake manifold. In either case the fuel and air mixture is compressed and ignited, with the combustion generating power at the output shaft of the engine.

The amount of fuel and air necessary to secure proper combustion will vary according to the type of fuel used, altitude, speed, load, temperature and design of the engine. The carburetor is used to control the mixture of air and fuel to the engine.

The air flow through the carburetor is commonly controlled by a pivoted valve, commonly a butterfly-type valve located between the carburetor and the fuel intake manifold. A user typically directs the throttle valve into an open position by depressing a gas pedal, or moving a throttle lever. The opening of the valve allows more air to flow into the engine, with the negative pressure from the intake stroke of the pistons causing the air to flow through the carburetor. The increased air flow uses a venturi effect to draw fuel out of openings disposed within the air flow. The greater the air flow velocity, the more fuel that is drawn into the stream of air.

U.S. Pat. No. 4,872,440 to Green is of this general type. Green describes rotating rings which adjust the amount of air flow, with the air flow in turn affecting the amount of vacuum that draws fuel into a mixing chamber and then into the engine. Similarly, Fabritz U.S. Pat. No. 4,058,102 describes a reciprocal plate which varies the air flow which in turn affects the atomization of fuel used by an engine. In both the Green and Fabritz patents, the air flow aperture is varied, and the amount of fuel is indirectly varied according to the air flow passing through the air flow valve.

In other carburetors, fuel flow is controlled, while air flow is indirectly varied. The patent to Kendig, U.S. Pat. No. 4,482,507, describes a fuel dispersion bar extending across a flow passage below two generally rectangular valve gates. The dispersion bar has fuel flow slits which are simultaneously opened, closed, or partially opened by longitudinally moving a shaft. The shaft movement is controlled by the fuel pressure through a diaphragm in a fuel pressure control assembly. The amount of fuel flow is indirectly affected by the opening of the valve gates through the fuel pressure diaphragm, and through the longitudinal movement of the shaft which varies the fuel aperture.

The metering systems of Kendig, as well as other metering systems used in the prior art are disadvantageous because of the resulting complexity of the carburetor. The indirect link between the throttle valve, the air valve, and fuel dispersion system requires a large number of components making the carburetor not only more expensive, but more susceptible to breakdown and failure. There is thus a need for a simple carburetor providing desirable control over the air to fuel mixture.

The prior art carburetors have a number of adjustment capabilities, which when combined with the indirect affect air flow has on fuel flow, results in a carburetor which is difficult to adjust for optimum performance. There is thus a further need for a carburetor which permits the synchronous adjustment of airflow and fuel flow without the need of numerous and complex components.

When the carburetor metering systems of the prior art are adjusted for optimum performance at a particular altitude, the carburetor maintains that predetermined setting regardless of the altitude. At higher altitudes, the size of the air opening in the carburetor may be the same, but the amount of air flowing through the opening is reduced because of the reduced air density at higher altitudes. Thus the engine performance is reduced as the altitude varies. This is a constant problem for motorists living near mountains, or those who travel across the country. There is thus a need for a carburetor which accommodates for the effects of differential altitude.

It is therefor an object of the present invention to provide a relatively simple carburetor whereby the air flow and fuel flow are directly controlled, rather than being indirectly controlled and connected.

It is a further object of the present invention to provide a new mechanism and method of dispersing the fuel into the air stream through the carburetor.

It is a further object of the present invention to provide a carburetor design which accommodates for the adverse effects which altitude variations may have upon engine performance.

It is a further object of the present invention to provide a carburetor which provides a simple adjustment and variation of the carburetor's performance.

SUMMARY OF THE INVENTION

The carburetor of this invention provides a mechanism for directly controlling both the airflow valve and the fuel dispersion mechanism, both of which are advantageously located within the carburetor housing. This direct control allows the carburetor to compensate for the affects of altitude variation on engine performance by adjusting the air and fuel ratio as the altitude varies. This direct control is achieved by connecting the airflow valve directly to the fuel dispersion mechanism, thus eliminating the complexity and performance variability effects of the indirect coordination of the fuel and air in prior art carburetors. This direct control further allows the carburetor to be of simpler and more durable construction, while allowing for simpler adjustment of the carburetor performance.

The carburetor of the present invention comprises a housing having a passageway therethrough. At one opening of the carburetor is an airflow valve, the operation of which regulates the amount of air flowing through the passageway. The airflow valve consists generally of two pivoting gates which pivot about horizontal parallel axes, with the edges of the gates abutting one another between the pivot axes when they are in the closed position. Rotating countercurrent to each other, the valve gates open or close to vary the area through which air can flow. As the gates in the carburetor are opened wider, a greater amount of air is permitted to flow therethrough.

In the preferred embodiment, each gate of the airflow valve rotates synchronously with the other by way of a mechanical gear assembly positioned on the exterior of the housing. Each gate pivots about an axle having bearings disposed in opposite walls of the carburetor housing. One end of each axle extends through one housing wall to accept a gear imposed concentrically thereon. Interposed between the axle gears is a pair of additional gears intermeshed with the axle gears. With this arrangement, as one airflow valve gate pivots in one direction into the interior of the housing, the other gate is synchronously pivoted in the opposite direction so as to permit symmetric opening and closing of the valve gates. Preferably, the gear assembly is spring-loaded to return the air valve gates to their normally closed position.

Mounted within the housing is a throttle valve which, in the preferred embodiment, is positioned at an opening opposite to the location of the airflow gate valve. The linkage assembly connects the throttle valve to a throttling mechanism for manually controlling the position of the valve. The throttling mechanism most recognizable by the average person is the conventional gas pedal, located in the driver area of an automobile. The gas pedal is connected, via a linkage assembly, to the throttle valve in the carburetor, so that activation of the gas pedal directs the position of the throttle valve.

The throttle valve opens or closes the air passageway extending through the length of the carburetor, thereby exposing the interior of the carburetor to the intake manifold of the engine. When the throttle valve is opened, the negative pressure created by operation of the combustion chamber of the engine exerts a differential pressure on the airflow valve, thereby drawing the airflow gates open. External air from above the carburetor is then drawn downwardly therethrough and directed toward the combustion chamber.

Also enclosed within the carburetor housing is a fuel dispersion assembly which is directly and mechanically linked to the airflow valve. In the preferred embodiment, the fuel dispersion system comprises a pair of concentric tubes, one rotatable relative to the other and both having one or more radial slots therethrough. The concentric tubes are preferably positioned between the airflow valve and the throttle valve. In an alternative embodiment, the throttle valve is positioned between the airflow valve and the fuel dispersion system.

The center tube in the fuel dispersion assembly, referred to as the "slave" tube, contains fuel that is received from a fuel storage tank and directed into the carburetor through a fuel pump. The outer tube which encloses the slave tube is called the "sleeve" tube and remains affixedly secured to the carburetor housing. The slave tube is rotatable in a set of bearings disposed within opposing carburetor walls and rotates relative to the sleeve tube. The slots in the tubes are preferably oriented radially about a portion of the circumference of each tube and positioned so that, upon rotation of the slave tube within the sleeve tube, a portion of the slots in each tube overlap, providing fluid communication between the interior of the slave tube and the exterior of the sleeve tube. Preferably, the slots are oriented in the direction of the air flow, and subtend an angle of about 120° of the circumference of the tube. In such positions, the overlapping portions provide a passageway for the fuel, contained in the slave tube, to disperse within the carburetor.

At a first relative position the slave tube is positioned within the sleeve tube such that none of the corresponding slots are overlapping, thereby precluding the dispersion of fuel within the carburetor. At a second relative position, the slave is rotated a certain distance to permit a certain portion of the slave tube slot to overlap the sleeve tube slot and allow a desired quantity of fuel to be dispersed within the carburetor housing. As increased power is desired, the slave tube is further rotated in the same direction to permit a greater overlap of the sleeve tube and slave tube slots, thereby translating into an increased dispersion of fuel within the carburetor.

The fuel dispersion assembly and the airflow valve are mechanically connected by a three-bar linkage assembly with the middle linkage arm being of adjustable length. The first and third linkage arms have one end pivotally mounted, with their remaining ends being connected to opposite ends of the middle linkage arm. The pivotally mounted end of the first linkage arm is connected to one end of one of the gate axles, and rotates as the gate axle rotates. The third linkage arm is connected to the slave tube of the fuel dispersion assembly so that rotation of the third linkage arm rotates the slave tube and varies the overlap of the slots in the tubes. As the gate axle pivots, the first linkage arm rotates, simultaneously moving the adjustable middle arm downward. The carburetor thus advantageously provides for the dispersion of fuel in direct response to the position of the airflow valve.

By manipulating the adjustable middle arm, the initial position of the slave tube, relative to the position of the airflow valve, can be adjusted. The relative position of the slave and sleeve tube affects the air to fuel ratio at a particular RPM setting. As such, where it is desired to increase or decrease the air/fuel ratio, the adjustable middle arm can be either extended or retracted, respectively.

The slots located on the sleeve tube are oriented downwardly so that fuel is dispersed through the sleeve tube toward the bottom of the carburetor. In the "off" position, the slots of the slave tube are positioned to the side or above the corresponding slots of the sleeve tube. As the slave tube is rotated relative to the sleeve tube, fuel, contained within the slave tube, is dispersed at one edge of the sleeve slot, corresponding to the position of overlap. With a small area of overlap, it will be appreciated that the width of fuel spray is correspondingly small. As the slave tube rotates further in the same direction, simultaneously increasing the amount of fuel dispersed, the arc of spray spreads across the bottom of the carburetor in a fan-like configuration.

At the base of the carburetor housing is a flange having slots at each of four corners thereof through which fasteners may be inserted. The flange is sized to mate with a corresponding flange on the air intake manifold of a conventional engine. With this arrangement, it is intended that the carburetor of the present invention be easily substituted for a conventional carburetor.

The present invention advantageously provides a carburetor which meets the needs of the objects of the invention stated above. Other advantages of the present advantage may be further appreciated by reference to the drawings.

DETAILED DESCRIPTION

Figure 1:
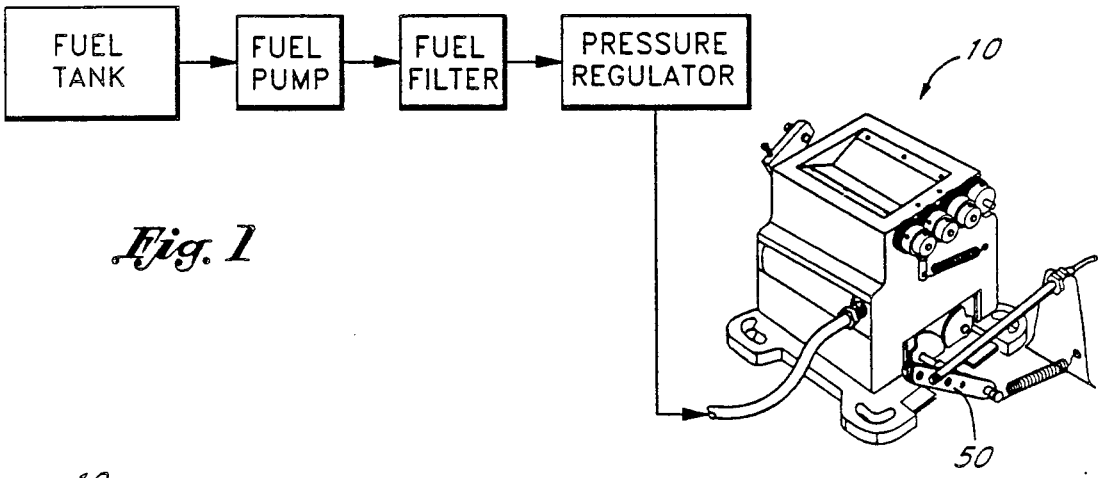
FIG. 1 is a schematic diagram showing the relationship of the carburetor of the present invention to a fuel tank.

Reference is now made to the figures, wherein like elements are designated with like numerals. Referring to FIG. 1, a carburetor 10 of the present invention is shown. Interposed between a fuel storage tank and a combustion chamber in the engine (not shown), the carburetor 10 is configured to mount directly to the top of conventional air intake manifolds (not shown). Most conventional four-barrel carburetors are manufactured to standard housing sizes. The improved carburetor 10 is advantageously sized so that it may easily replace most four-barrel carburetors, or if sized appropriately, replace other carburetors.

The carburetor 10 is shown schematically succeeding several conventional fuel line components; most notably, a fuel storage tank, a fuel pump, a fuel filter and a pressure regulator. The carburetor 10 is directly connected to the fuel storage tank via a fuel line, partially shown in FIG. 1. While such components are well known in the field, they are schematically shown merely to assist in understanding the relationship of the carburetor to other engine components.

Figure 2:
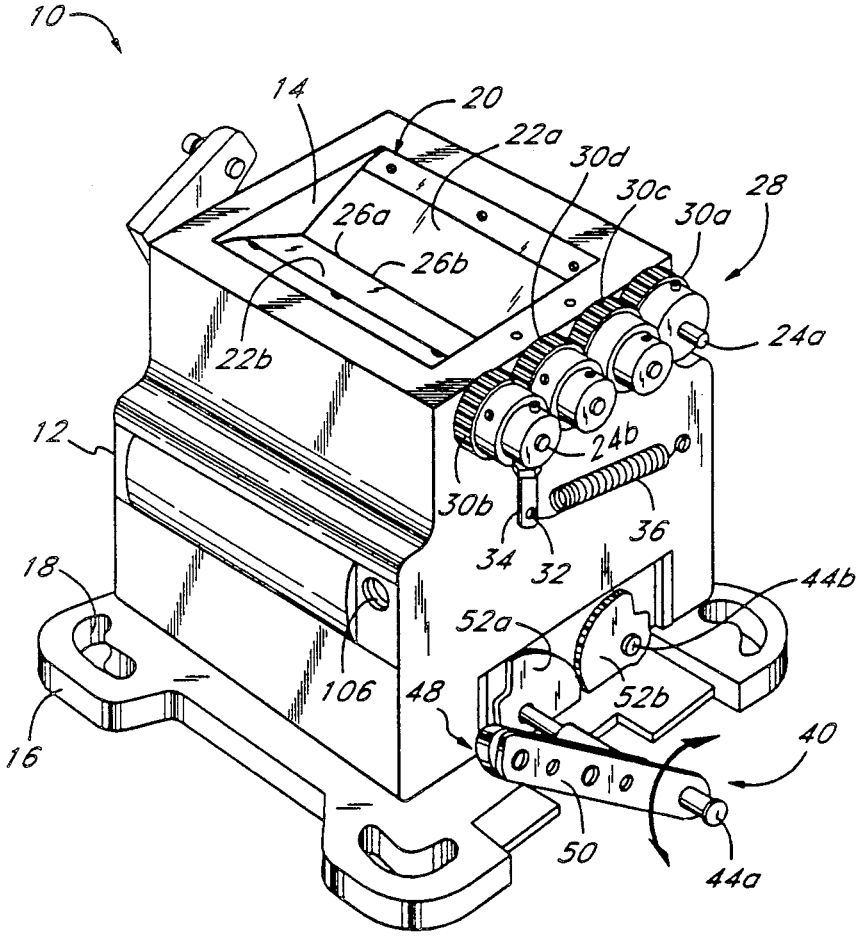
FIG. 2 is an elevated perspective view of the carburetor.

Referring to FIG. 2, the carburetor 10 comprises a housing 12 of preferably unitary, metal casting construction, shaped in a generally square configuration. The carburetor housing 12 has a generally rectangular central opening 14 through the center of the housing 12, and a flanged base 16 at the bottom. Located at the bottom four corners of the flanged base 16 are slots 18 to accommodate a mechanical connection to an air intake manifold (not shown). It is intended that conventional fasteners, such as bolts (not shown), will be used to secure the carburetor 10 to the intake manifold. The slots 18 allows the carburetor 10 to be fitted onto a variety of manifolds.

Disposed within the top portion of opening 14 of housing 12 is an airflow valve 20, which may be controllably opened or closed to permit the passage of air through the improved carburetor 10. In the preferred embodiment, the airflow valve 20 comprises two opposing gates, **22*a* and 22*b*, which are pivotally secured to the carburetor housing 12 by a first and second axle, 24*a* and 24*b*. When the airflow valve 20 is in its closed position, forward edges 26*a* and 26*b* of each generally rectangular gate, 22*a* and 22*b*, respectively, are in contact at a position below the plane in which pivot axles 24*a*, 24*b* are located. When fully closed, the airflow valve 20 is configured in a "V" shape. While that is the preferred configuration, the carburetor can operate with the valve 20** in a substantially flat position.

At a first end of each axle, **24*a* and 24*b*, is positioned a radial gear assembly 28, comprising a plurality of gears generally indicated as 30*a*–30*d*. In the preferred embodiment, the gear assembly 28 comprises four intermeshed gears 30*a*–30*d*. Mechanically secured to each axle, 24*a* and 24*b*, are radial gears 30*a* and 30*b*, respectively, which are concentrically mounted thereon. Interposed between gears 30*a* and 30*b*, are two intermediate gears, 30*c* and 30*d*, rotatably mounted to the exterior of the carburetor housing 12. Spur gears 30*a*–30*d* are aligned in a co-planar arrangement so as to permit direct mechanical connection between the two valve gates, 22*a* and 22*b*. The gears 30*a*–30*d*** are intermeshed so that the clockwise rotation of one valve gate about its axle mechanically and reciprocally actuates the counterclockwise rotation of the opposing valve gate.

The gear assembly 28 is preferably spring-loaded to return the air flow valve 20 to its normally-closed position when air flow through the improved carburetor 10 ceases. Secured to gear **30*b* is a spring arm 32 having a hole 34 at its free end to engage a linear tension spring 36. While the illustrated embodiment includes a linear extension spring 36**, any spring arrangement which exerts a restorative torsional load on at least one valve gate axle will also function. An alternative embodiment could include a linkage assembly using a plurality of spring-loaded arm members which mechanically link the pivotal movement of one gate to the other valve gate.

Figure 5:
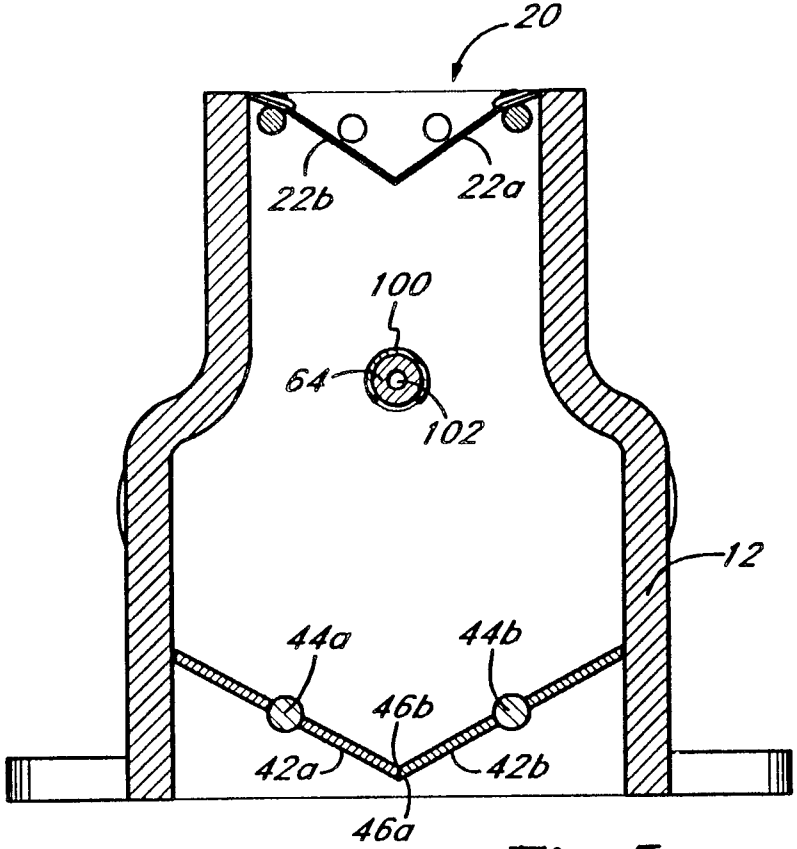
FIG. 5 is a sectional view taken along Section 5—5 of FIG. 2.

Referring to FIGS. 2 and 5, a throttle valve assembly 40 is disposed within the lower portion of the carburetor housing 12. The throttle valve assembly 40 comprises a pair of generally rectangular throttle valve gates, **42*a* and 42*b* (FIG. 5), rotatably mounted to the carburetor housing 12 by way of two throttle gate axles, 44*a* and 44*b*, respectively. Referring to FIG. 5, the throttle valve gates 42*a*, 42*b* are positioned in a "V" configuration, similar to airflow valve gates 22*a* and 22*b*. When the throttle valve 40 is closed, the forward edge 46*a*, 46*b* of each throttle valve gate 42*a*, 42*b* are engaged, thus effectively sealing off the flow of air through the carburetor 10. As each gate pivots in opposing directions, the forward edges 46*a*, 46*b*** separate providing an area for the flow of air.

Referring to FIGS. 1, 2 and 5, actuation of the throttle valve assembly 40 depends upon a linkage assembly 48, represented partially by a linkage arm 50 secured to the gate axle **44*b* at a position exterior to the carburetor housing 12. The throttle valve assembly 40 is mechanically linked to an accelerator pedal (not shown) remote from the carburetor. When the accelerator pedal is depressed, the throttle valve is actuated, whereby the first throttle valve gate 42*a* is pivoted in a radial direction, which in turn directs the pivoting of the second throttle valve gate 42***b* by way of two intermeshed quarter gears 52*a* and 52*b*. Each of the quarter gears 52*a*, 52*b* are secured to the throttle valve gate axles 44*a*, 44*b*, respectively.

The throttle valve 40 provides a shut-off valve between the carburetor and the cylinders of the engine. When the throttle valve 40 is opened, negative pressure is realized within the interior of the carburetor housing 12 thereby drawing open the airflow valve 20 and ultimately permitting the flow of air through the improved carburetor 10.

Figure 3:
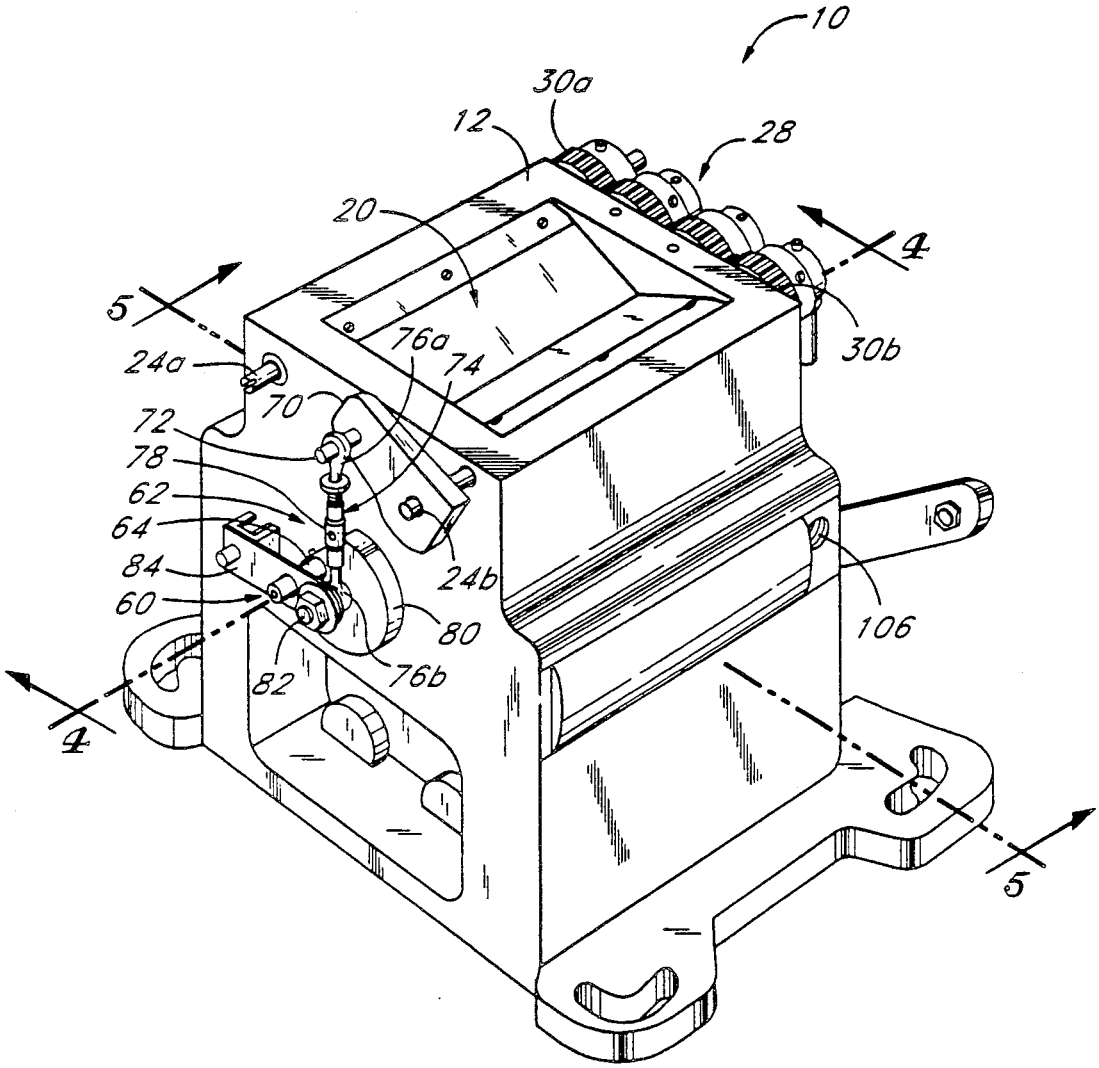
FIG. 3 is an elevated perspective view of the carburetor.
Figure 4:
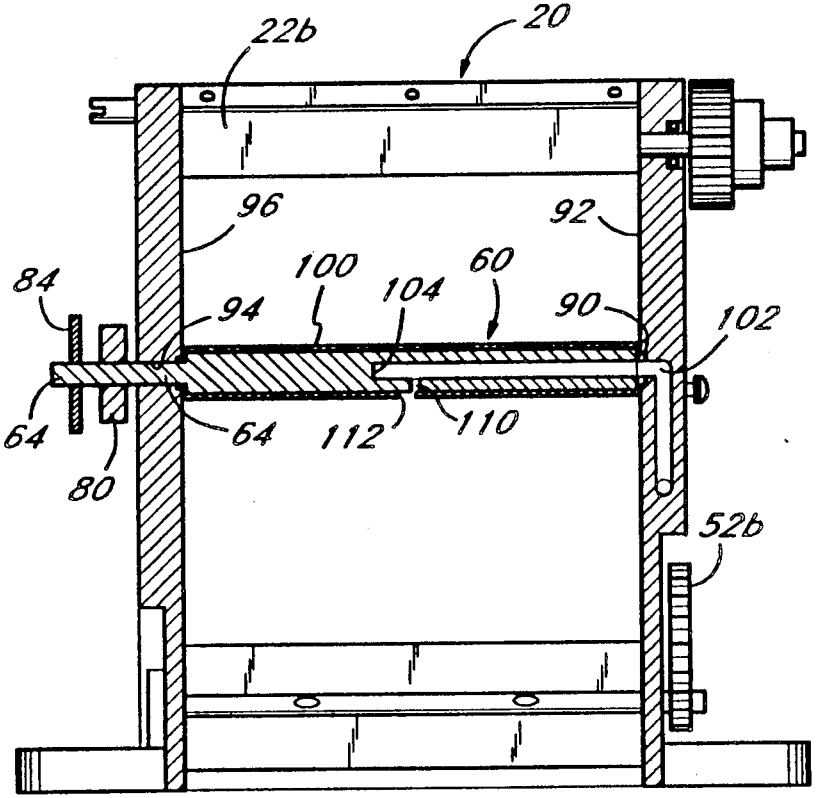
FIG. 4 is a sectional view taken along Section 4—4 of FIG. 3.

Referring now to FIGS. 3 and 4, disposed within the carburetor housing 12 is a fuel dispersion assembly 60, shown partially mounted to the exterior of the carburetor housing 12. The airflow valve 20 is directly and mechanically linked to the fuel dispersion assembly 60 by a linkage assembly 62. The operation of the fuel dispersion assembly 60 primarily depends upon the rotation of a slave tube 64 disposed generally within the carburetor housing 12, a portion of which extends through the housing wall and is connected to linkage assembly 62.

The linkage assembly 62 comprises an air valve bell crank 70 having a first end connected to valve axle 24*b*. Secured to a second end of air valve bell crank 70 is a pin 72 projecting outwardly from the air valve bell crank. One of the linkage members is advantageously made adjustable. Thus, rotatably connected to the pin 72 is a turnbuckle 74, comprising an assembly of cylindrical rods 76*a* and 76*b*, each having threads at one end and an eyelet at the other. Connecting the two cylindrical rods 76*a*, 76*b* is a connector 78, wherein rotation of the connector 78 adjusts the distance between eyelets thereby lengthening or shortening the length of adjustable arm 74. The eyelet of cylindrical rod 76*b* is rotatably connected to one end of a slave tube bell crank 80 through pin 82. The slave tube bell crank 80 is mounted at one end of, and rotates with, slave tube 64. With such an arrangement, rotation of valve axle 24*b*, in response to the opening or closing of airflow valve 20, directly actuates rotation of slave tube 64 through the linkage assembly 62, to provide direct mechanical coordination between operation of the airflow valve 20 and the fuel dispersion assembly 60. Secured about both the slave tube 64 and pin 82 is a retainer 84 which functions to preclude lateral movement of the slave tube 64 within the carburetor housing 12.

By adjusting the turnbuckle 74, the initial radial position of the slave tube 64 relative to the position of the airflow valve 20 can be adjusted. The relative position of the slave tube 64 affects the air to fuel ratio at a particular RPM setting. As such, where it is desired to increase or decrease the air/fuel ratio, the turnbuckle 74 can be either extended or retracted, respectively. It is contemplated that the air valve bell crank 70 or the slave tube bell crank 80 may also be of adjustable lengths. By increasing or decreasing the distance that pins 72 and 82 extend from the air valve axle 24*b* and the slave tube 64, respectively, i.e., the radius of rotation, adjustability of the rate at which fuel is dispersed within the carburetor is thereby provided.

In FIGS. 4 and 5, the fuel dispersion assembly 60 is shown as comprising two concentric tubes 64, 100, one housed within the other, and positioned transversely across the interior of the opening 14 of carburetor housing 12. The inner tube or slave tube 64 is rotatably mounted to the carburetor housing 12 such that one end rests within a bearing 90 disposed in wall 92 and the other end extends through an opening 94 in wall 96. A portion of the slave tube 64 passing though wall 96 extends to the exterior of the carburetor housing 12 for engagement with the linkage assembly 62 as described above. With such an arrangement, the slave tube 64 may be rotated about its longitudinal axis within the interior of carburetor housing 12.

The outer tube or sleeve tube 100 is mounted to the carburetor housing 12 at wall 92 and wall 96. The sleeve tube 100 is positioned relative to the slave tube 64 so as to permit free rotation of the slave tube 64 within the sleeve tube 100. In the preferred embodiment, the sleeve tube remains affixedly positioned as the slave tube 64 rotates therewithin. As shown in FIG. 4, a fuel supply line 102 is housed partially within wall 92 and extends axially along the center of slave tube 64, terminating at an end 104 interior to the slave tube 64.

Referring to FIGS. 2 and 4, an opening 106 (FIG. 2) is provided in the carburetor housing 12 located at an end of the fuel supply line 102 (FIG. 4) opposite to end 104. Opening 106 provides a means for external supply of fuel to the carburetor 10 by placing the interior of the slave tube 64 in fluid communication with the fuel supply line 102 such that fuel received from the fuel tank and passing though fuel supply line 102 accumulates within slave tube 64 for mixing with air in the carburetor 10.

Figure 6:
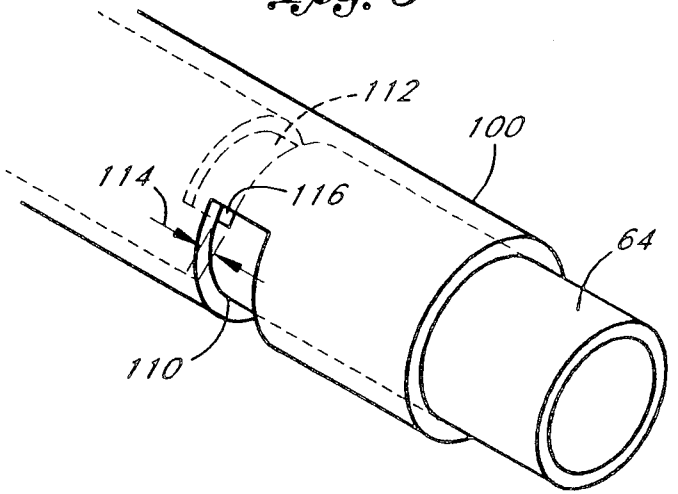
FIG. 6 is a partial perspective view of the slotted slave and sleeve tubes of the fuel dispersion assembly.

Referring now to FIGS. 5 and 6, the relationship between the slave tube 64, sleeve tube 100 and fuel supply line 102 will be described. Fuel is disbursed within the carburetor housing 12 through one or more sets of cooperating slots, preferably rectangular in shape and radially positioned on the slave and sleeve tubes 64, 100, respectively. The sleeve tube 100 is thus provided with a first radial slot 110 extending over an arc of about 120°. The slot 110 is in fluid communication with the fuel supply line 102 adjacent end 104. The slave tube 64 is provided with a second radial slot 112 which extends over an arc equal to or greater to the length of sleeve tube's slot 110. Preferably, slave tube slot 112 extends over an arc of about 130° and is oriented in the same direction as the air flow through the carburetor 10. However, it is to be understood that the carburetor remains effective at greater or lesser arc lengths for the slots 110, 112.

The sleeve tube slot 110 and slave tube slot 112 are of finite widths, preferably about 0.090 inches across. Sleeve tube slot 110 and slave tube slot 112 are axially positioned on the sleeve tube 100 and slave tube 64, respectively, such that they axially overlap a finite distance 114. The preferred length of axial overlap is about 0.014 inches, although other lengths would also function. When the sleeve tube 100 and the slave tube 64 are radially positioned to provide an area of overlap 116 having width 114, the fuel accumulated within the interior of slave tube 64 flows out of the fuel dispersion assembly 60 through the overlap area 116, into the interior of the carburetor housing 12.

As the sleeve tube 100 remains stationary, the slave tube 64 may be rotated to decrease or increase the size of the area of overlap 116. As the area of overlap 116 is increased, a greater amount of fuel flows through the fuel dispersion assembly 60. As a result, the quantity of fuel flow may be directly controlled by the positioning of slave tube 64 relative to sleeve tube 100. When the engine to which the improved carburetor 10 is incorporated is not being operated, that slave tube 64 will be radially positioned relative to sleeve tube 100 such that no area of overlap is provided, thereby precluding the flow of fuel through the fuel dispersion assembly 60 and into the carburetor housing 12. When engine operation is commenced, slave tube 64 will be rotated to a first radial position, predetermined by the area of overlap 116 necessary, and simultaneously the amount of fuel desired, to permit engine idling. When it is desired to increase the power output of the engine, the slave tube 64 can be further rotated to increase the area of overlap 116 thereby providing a greater amount of fuel flow through the fuel dispersion assembly 60.

Figure 7A:
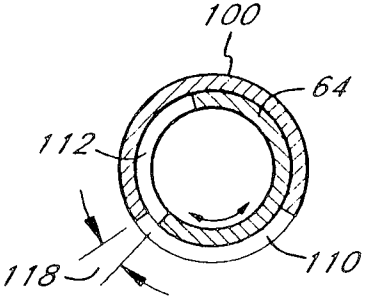
FIG. 7A is a cross-sectional view of the radial relationship of the slave and sleeve tubes in an idling position.
Figure 7B:
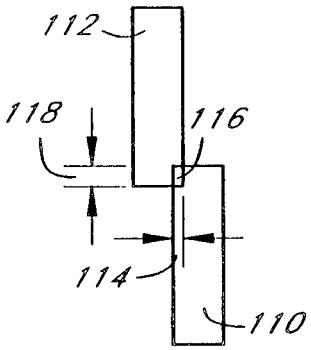
FIG. 7B is a view of the overlapping relationship of the slave tube slot and sleeve tube slot of FIG. 7A, as illustrated in a flat plane.

Referring now to FIGS. 7A and 7B, the relative axially and radially position of slave tube 64 to sleeve tube 100 can be more fully appreciated. Specifically in FIG. 7A, the preferred embodiment of the improved carburetor 10 provides for a sleeve tube 100 having a sleeve tube slot 110 positioned downwardly relative to the axis of rotation. Preferably, the sleeve tube slot 110 is aligned symmetrically about a vertical plane passing through the center axis, as shown in FIG. 7A. It can be seen that at some predetermined idling position, variably dependent on the requirements of the user, the slave tube slot 112 radially overlaps sleeve tube slot 110 by an arc 118, thereby resulting in a dispersion of fuel in a small fan-like configuration. The arc 118 and the axial offset 114 (FIG. 6) define area 116. In FIG. 7B, the sleeve tube slot 110 and slave tube slot 112 are shown arranged in a horizontal plane for illustration. At the idling position shown in FIG. 7A, the area of overlap 116 is defined by the axial overlap length 114 and radial overlap arc 118. In the preferred embodiment, slots 110 and 112 are positioned parallel, but axially, such that axial overlap length 114 remains constant as the slots 110 and 112 rotate relative to each other.

Figure 8B:
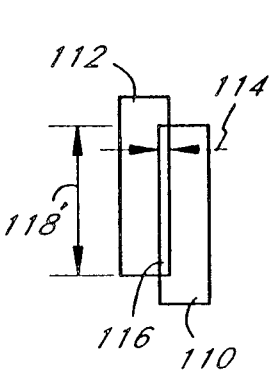
FIG. 8B is a view of the axial relationship of the slave tube slot and sleeve tube slot of FIG. 8A, as illustrated in a flat plane.
Figure 8A:
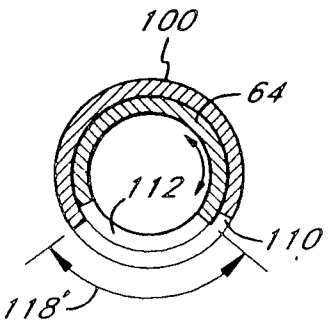
FIG. 8A is a cross-sectional view of the radial relationship of the slave and sleeve tubes in a position indicative of high fuel flow.

Referring to FIGS. 8A and 8B, further rotation of the slave tube 64 relative to sleeve tube 100 is shown. In FIG. 8A the slave tube 64 is shown at a radial position counterclockwise from that shown in FIG. 7A. The increased arc of overlap between the two slots is designated 118'. Referring now to FIG. 8B, the increased area of overlap 116' is shown defined by the axial overlap length 114 and radial overlap arc 118'. It should be appreciated by comparing FIGS. 7A and 7B that the width of fuel dispersion is increased as the area of overlap is increased. Whereas in FIG. 7A fuel is dispersed only toward one side of the carburetor 10, in FIG. 8A fuel is dispersed about the entire width of carburetor 10. The dispersion of fuel into the interior housing 12 extends over a wider area as the slave tube 64 is rotated relative to sleeve tube 100 to define a larger fan type are of fuel dispersion. For example, radial arc 118 may be 10° while radial arc 118' may be 90°.

As indicated above, adjustment of turnbuckle 74 (FIG. 3) affects the relative position of slave tube 64 to sleeve tube 100 and thereby affecting the amount of overlap arc 118 at any stage of airflow valve movement. Since the amount of overlap arc 118 determines the amount of fuel dispersed within the carburetor housing 12, extension or retraction of turnbuckle 74 in turn increases or decreases the air to fuel ratio, thereby providing alternatively richer or leaner fuel proportions.

Figure 9A:
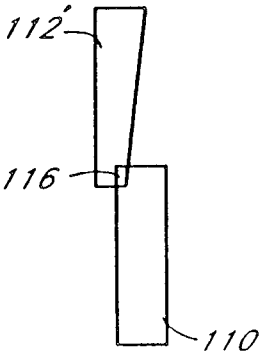
FIG. 9A is an alternative embodiment of the slave tube slot illustrated in FIG. 7B.
Figure 9B:
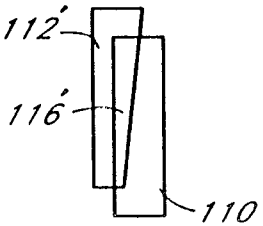
FIG. 9B is an alternative embodiment of the slave tube slot illustrated in FIG. 8B.

While the preferred embodiment incorporates generally rectangular slots 110 and 112, it is contemplated that other shapes may be employed which define differently shaped areas of overlap. For example, and not by way of limitation, FIGS. 9A and 9B illustrate a slave tube slot 112' configured in a generally trapezoidal shape. In an initial idling position as shown in FIG. 9A, the area of overlap is designated 116. As the slave tube is rotated relative to the sleeve tube, the area of overlap is increased as shown in FIG. 9B and designated 116'. As may be appreciated from comparing FIG. 8B and 9B, the trapezoidal shape of slave tube slot 112' provides a greater area of overlap 116' than that provided with a rectangular slave tube slot 112 for the same degree of rotation of the slave tube 64. It may be appreciated that in the preferred embodiment illustrated in FIGS. 7B and 8B, the change in the area of overlap is directly proportional to the arc of overlap. In the alternative embodiment illustrated in FIG. 9B, the relationship between the area of overlap and the arc of overlap is non-linear, and in fact, increases at a faster rate. Other configurations, not shown, are contemplated for use with the improved carburetor 10 wherein the area of overlap increases as the slave tube 64 rotates relative to sleeve tube 100. For example, the slots may be positioned axially along each tube, or in a skewed orientation, rather than radially as provided in the preferred embodiment.

As illustrated in FIGS. 6 and 7B, the slots 110, 112 are wider than the axial overlap 114. This allows the slots 110, 112 to be fabricated by using wider cutting blades to cut the slots 110, 112 into the tubes 64, 100. Having slots 110, 112 wider than the axial overlap 114 also allows for greater assembly tolerances and adjustment in the axial overlap length 114. It is contemplated, however, that the slots 110, 112 could be of the same width as the axial overlap length 114.

In light of the above description, it will be appreciated that the rate of fuel flow into the carburetor housing 12 is directly controlled by the size of the opening formed by air flow valve 20. As the airflow valve 20 opens, the valve gates **22*a* and 22*b* rotate, thereby actuating, via linkage assembly 62, rotation of the slave tube 64. The slots 110 and 112 are configured such that as the airflow valve 20 opens to a greater extent, the area of overlap 116 of slots 110 and 112 increases. In other words, as the amount of air flow through the carburetor 10 increases, the amount of fuel flow simultaneously increases, directly controlled by the position of the airflow valve 20. With such an arrangement, the carburetor 10** advantageously eliminates extraneous components necessary to accommodate a metering system as described in reference to prior art carburetors.

An important advantage of the present invention is that it compensates for a change in altitude which normally has an adverse effect on the performance of conventional carburetors. As indicated above, when the carburetor metering systems of the prior art are adjusted for optimum performance at a particular altitude, the carburetor maintains that predetermined setting regardless of the altitude. At higher altitudes, the size of the air opening in the carburetor may be the same, but the amount of air flowing through the opening is reduced because of the lower density of air at higher altitudes, thus reducing engine performance. The carburetor of the present invention adjusts to the change in altitude by automatically opening the airflow valve to a wider position, in response to actuation of the throttle valve, thereby permitting a greater flow of air therethrough. Simultaneously, the amount of fuel flow is directly regulated responsive to the amount of air flow, providing an optimal fuel and air mixture even for lower density air environments.

It is to be understood that the carburetor housing of the present invention need not be of unitary construction, but may comprise a plurality of components having flanges which may be mechanically mated in a stacked formation. For instance, it is conceivable that the throttle valve would be positioned within one component while the airflow valve and the fuel dispersion assembly would be positioned in a second component, whereby the two components may be mechanically connected and installed as a unit on a conventional internal combustion engine.

The invention may be embodied in other specific forms without departing from its spirit or essential characteristics. The described embodiment is to be considered in all respects only as illustrative and not restrictive. The scope of the invention is, therefore, indicated by the appended claims rather than by the foregoing description and drawings, and all changes that come within the meaning and range of equivalency of the claims are to be embraced within their scope.

What is claimed is:

1. A fuel and air regulating mechanism providing synchronous adjustment of both air and fuel flows to an internal combustion engine, comprising:

a housing having an opening through which air passes into the mechanism, an air passageway through the mechanism, and an exit opening which may be placed in fluid communication with the internal combustion engine;

a fuel dispersion assembly for dispersing fuel into the air passageway, the fuel dispersion assembly comprising an outer and inner tube, concentrically positioned, the tubes being rotatable relative to one another and containing overlapping slots located in the periphery of the tubes through which fuel may flow into the air passageway in a fan-like arc the size of which varies with the amount by which the slots overlap, the dispersion assembly being located in the air passageway at about the center of the opening in the mechanism but downstream from the opening;

an airflow valve assembly having two plates rotating about substantially parallel axes but interconnected by gears so the plates rotate in opposite directions to regulate the size of opening through which air may flow into the housing, the tubes of the fuel dispersion assembly being located downstream from, and substantially parallel to, the rotational axis of the plates; and a linkage mechanically interconnecting the movement of one of the tubes of the fuel dispersion assembly with the rotation of one of the plates of the airflow valve assembly to vary the amount of fuel dispersed in proportion to the size of the opening in the airflow valve assembly.

2. The mechanism of claim 1, wherein the inner tube rotates relative to the outer tube.

3. The mechanism of claim 1, wherein the amount of axial overlap of the slots remains substantially constant and the amount of radial overlap of the slots varies as the inner tube is rotated.

4. The mechanism of claim 1, wherein an amount of axial and radial overlap of the slots varies as the inner tube is rotated relative to the outer tube.

5. The mechanism of claim 1, wherein the linkage mechanism contains two linkages with adjustable lengths, wherein the length of one of the adjustable linkage arms is adjustable so as to permit adjustment of a rate of fuel dispersion.

6. The mechanism of claim 1, wherein fuel is dispersed over a small arc and towards one side of said carburetor when fuel flow is small.

7. A mechanism as defined in claim 1, wherein the slots are of substantially uniform width along the length of the slots which overlap.

8. A mechanism as defined in claim 1, wherein one of the slots has a trapezoidal shape.

9. A mechanism as defined in claim 1, wherein the slots subtend an arc of about 120° degrees when they are overlapping as much as possible.

10. A fuel and air regulating mechanism for use with an internal combustion engine, the mechanism having a passage through which air flows to the engine, comprising:

a generally rectangular shaped air flow valve comprising two valve gates each of which is rotatably mounted along one side and which adjoins the other gate along the side opposite the rotatably mounted side, the air flow valve defining a variable opening through which air flows into the mechanism;

a slave member located downstream of the air flow valve and rotatably mounted to the carburetor, the slave member having a longitudinal axis aligned with the axis of rotation of the valve gates and located in the middle of the valve gates but downstream of the valve gates, the slave member having a fuel passage therein communicating with one end of the member, the member having a first opening in fluid communication with the fuel passage; and a sleeve member coaxial with the slave member, the sleeve member having a second opening, with the slave member and sleeve members being relatively positioned so that a portion of the first and second openings overlap, with the amount of overlap varying with the rotation of the sleeve member, so that fuel may flow through the overlapping openings into the air stream;

a mechanical linkage between the air flow valve and the slave member which directly connects the rotation of the valve gates with the rotation of the slave member and thus with the amount of overlap of the first and second openings, the mechanical linkage having a first adjustable linking arm to adjust the air to fuel ratio and having a second adjustable linking arm to adjust the rate of fuel dispersion.

11. A mechanism as defined in claim 10, further comprising:

a throttle valve positioned to obstruct the passage through the mechanism to vary the amount of air flow through the passage, and wherein the slave member is positioned downstream of the airflow gates and upstream of the throttle valve.

* * * * *